US011358835B2

(12) United States Patent
Korvenranta

(10) Patent No.: US 11,358,835 B2
(45) Date of Patent: Jun. 14, 2022

(54) METHOD FOR ROPING AN ELEVATOR

(71) Applicant: Kone Corporation, Helsinki (FI)

(72) Inventor: Sakari Korvenranta, Helsinki (FI)

(73) Assignee: Kone Corporation, Helsinki (FI)

( * ) Notice: Subject to any disclaimer, the term of this patent is extended or adjusted under 35 U.S.C. 154(b) by 0 days.

(21) Appl. No.: 17/022,490

(22) Filed: Sep. 16, 2020

(65) Prior Publication Data

US 2021/0130131 A1 May 6, 2021

(30) Foreign Application Priority Data

Oct. 31, 2019 (EP) ..... 19206410

(51) Int. Cl.
*B66B 7/08* (2006.01)
*B66B 5/28* (2006.01)
*B66B 7/10* (2006.01)

(52) U.S. Cl.
CPC ..... *B66B 7/08* (2013.01); *B66B 5/28* (2013.01); *B66B 7/10* (2013.01)

(58) Field of Classification Search
CPC .... B66B 7/08; B66B 5/28; B66B 7/10; B66B 19/02
See application file for complete search history.

(56) References Cited

U.S. PATENT DOCUMENTS 3,519,101 A * 7/1970 Sieffert ..... B66B 9/187 187/256
5,000,292 A * 3/1991 Chapelain ..... B66B 19/002 187/408
5,033,586 A * 7/1991 Richards ..... B66B 9/187 187/259
5,513,724 A * 5/1996 De Jong ..... B66B 7/06 187/264
8,141,684 B2 * 3/2012 Bjorni ..... B66B 11/08 187/264
8,205,720 B2 * 6/2012 Barneman ..... B66B 19/02 187/266
8,881,872 B2 * 11/2014 Peacock ..... B66B 19/00 187/414

(Continued)

FOREIGN PATENT DOCUMENTS

EP 2373565 A2 10/2011

OTHER PUBLICATIONS

CA European Search Report for Application No. EP 19206410, dated Apr. 29, 2020.

*Primary Examiner* — Michael A Riegelman
(74) *Attorney, Agent, or Firm* — Harness, Dickey & Pierce, P.L.C.

(57) ABSTRACT

A method for roping an elevator. At the bottom part of the elevator shaft the hoisting ropes are routed under the pulleys of the elevator car. Then the elevator car and the counterweight are hoisted to the upper part of the shaft where the first ends of the hoisting ropes are routed through the traction sheave and the counterweight pulleys. After that the first rope ends are fixed to the counterweight side rope terminals and the counterweight is lowered to the bottom part of the shaft. During the descent the hoisting ropes are unwound from the reels through the whole roping system with the help of the mass of the counterweight. Finally, the second ends of the hoisting ropes are fixed to the car side rope terminal and tightened to the correct tension.

17 Claims, 3 Drawing Sheets

(56) References Cited

Figure 1:
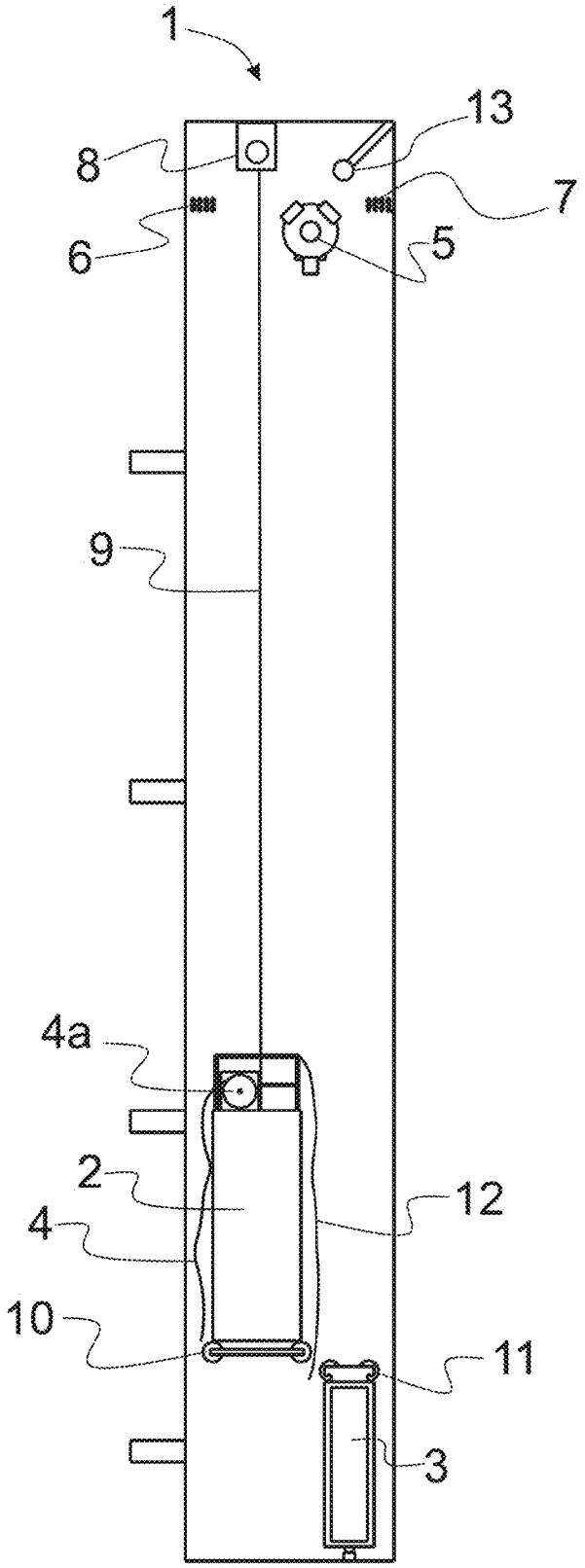

U.S. PATENT DOCUMENTS 8,943,695 B2 * 2/2015 Forsstrom ..... B66B 19/02 29/897
10,065,834 B2 * 9/2018 Ratia ..... B66B 7/06
10,227,212 B2 * 3/2019 Alasentie ..... B66B 7/062
10,501,289 B2 * 12/2019 Rasanen ..... B66B 19/005
2002/0066622 A1 * 6/2002 Pettersson ..... B66B 5/04 187/414
2004/0216958 A1 * 11/2004 Ach ..... B66B 11/008 187/254
2007/0181384 A1 * 8/2007 Cruz ..... B66B 19/02 187/411
2008/0116014 A1 * 5/2008 Ach ..... F16G 5/20 187/252
2010/0163347 A1 * 7/2010 Van Der Meijden ... B66B 19/00 187/254
2010/0163348 A1 * 7/2010 Barneman ..... B66B 19/02 187/266
2010/0243378 A1 * 9/2010 Begle ..... B66B 7/062 187/254
2011/0113720 A1 * 5/2011 Peacock ..... B66B 19/00 52/741.1
2012/0055002 A1 * 3/2012 van der Meijden .... B66B 19/02 29/428
2012/0124807 A1 * 5/2012 Mertala ..... B66B 19/00 29/428
2012/0217101 A1 * 8/2012 Peacock ..... B66B 11/00 187/414
2012/0291395 A1 * 11/2012 Plathin ..... B66B 19/02 52/741.1
2014/0075729 A1 * 3/2014 Kalliomaki ..... B66B 11/0065 29/401.1
2014/0231179 A1 * 8/2014 Alasentie ..... B66B 7/062 187/251
2015/0034425 A1 * 2/2015 Ratia ..... B66B 7/06 187/249
2015/0298940 A1 * 10/2015 Hense ..... B66B 5/042 187/254
2016/0318738 A1 * 11/2016 Alasentie ..... B66B 19/02
2017/0166419 A1 * 6/2017 Rasanen ..... B66B 19/005
2019/0352129 A1 * 11/2019 Jiang ..... B66B 19/00
2021/0130131 A1 * 5/2021 Korvenranta ..... B66B 7/10

* cited by examiner

METHOD FOR ROPING AN ELEVATOR

RELATED APPLICATIONS

This application claims priority to European Patent Application No. 19206410.3 filed on Oct. 31, 2019, the entire contents of which are incorporated herein by reference.

FIELD OF THE INVENTION

The present invention relates to a method for roping an elevator as defined in the preamble of claim 1.

New rope materials and new suspension techniques have enabled new technical solutions and construction concepts in elevator design. That has brought a need to develop new working methods for assembling modern elevators. Roping an elevator is no longer a simple task since the amount of parallel ropes, rope types and suspension techniques affect the roping process. Often, the difficulty of roping an elevator is to achieve an equal tightness to all the parallel hoisting ropes. The hoisting ropes tend to stretch or elongate when they are newly loaded, and this can cause different tightness on the ropes. Additionally, the high friction of e.g. polyurethane (PU) ropes makes trimming the tightness during the assembly difficult because the PU ropes do not slip on the machinery traction sheave or rope pulleys. Therefore, planning the roping process accurately benefits in less labour, time, accidents, unnecessary work, rope jamming and rope damages.

BACKGROUND OF THE INVENTION

Development of elevators has led to more complex suspension techniques. The 2:1 suspension demands twice as long ropes as 1:1 suspension, which makes the roping a more complex task. This can lead to problems when installing the hoisting ropes. To add friction between the ropes and the machinery traction sheave the ropes can be coated with friction adding material, such as polyurethane, later PU.

One way of installing the hoisting ropes is to lift rope reels to the upper part of the elevator shaft by means of a suitable lifting device, after which the ropes are lowered to the bottom part of the shaft. The problem with such a solution is first of all to lift the heavy rope reels to the upper part of the high elevator shaft. Another problem is that the lowering of long and heavy ropes is difficult to control because the lower the ropes are, the more their weight affects the rope-lowering machinery. A failure while lowering the ropes can lead the ropes to fall down at high speeds, which can cause hazards and/or break the structures.

In a conventional roping method free rope loops are lowered in the shaft onto top of the counterweight and the ropes are placed into the counterweight's diverting pulley grooves and after that the ropes are tightened and fixed to their terminals.

Disadvantages of the above-mentioned solution are inter alia that the rope loop may twist or get stuck behind some sharp object, e.g. rail brackets. PU coated ropes can easily be damaged in these kinds of cases and the elevator has to be roped again. This means significant additional working time and expensive material loss. Another disadvantage is that in the conventional method the parallel hoisting ropes can be left in uneven tightness and it does not take the rope elongation into account when the hoisting ropes are newly loaded.

OBJECT OF THE INVENTION

It is an object of the present invention to eliminate the aforementioned drawbacks and to provide a simple, safe, effective and inexpensive method for installing elevator hoisting ropes, which method is particularly well suited for elevators with low to medium hoisting heights. The process of the method is characterized by what is set forth in the characterizing part of claim 1. Other embodiments of the invention are characterized by what is stated in other patent claims.

A further object is to even out the tension of the hoisting ropes by keeping the bunch of ropes equally tight all the time. Newly installed ropes tend to elongate under load when they travel in pulley grooves. The present method for roping an elevator exploits the mass of the counterweight during the installation to stretch the hoisting ropes to their full length. This will result improved quality in roping.

Inventive embodiments are also disclosed in the specification of this application. The inventive content of the application may also be defined otherwise than as set forth in the claims below. The inventive content may also be formed by several separate inventions, especially if the invention is considered in the light of its expressions or implicit subtasks, or in terms of the benefits or groups of benefits achieved. In this case, some of the attributes contained in the patent claims below may be redundant for individual inventive ideas. Similarly, the various details presented in connection with each of the embodiments of the invention may also be used in other embodiments. In addition, it can be noted that at least some of the sub claims can be considered to be inventive as such, at least in appropriate situations.

BRIEF DESCRIPTION OF THE INVENTION

A method for roping an elevator where the roping starts at the bottom part of the elevator shaft where the first ends of the hoisting ropes are taken from reels from the roof of the elevator car and lead through diverting pulleys, preferably under the car and pulled back up with the help of an installation means, such as, a rope or ropes, to the car roof so that the hoisting ropes make a loop, preferably under the car. The elevator car is then hoisted to the upper part of the shaft where the first ends of the hoisting ropes are routed through the machinery traction sheave and the counterweight diverting pulleys, which counterweight has also been hoisted to the upper part of the shaft. Then the first rope ends are fixed to the counterweight side rope terminals. After that the counterweight is lowered to the bottom part of the shaft and during descent the hoisting ropes are unwound from the reels through the whole roping system with the help of the mass of the counterweight. When the counterweight reaches the stopper means in the pit the rope length is essentially correct. Then the second ends of the ropes are fixed to the car side rope terminals and tightened to the correct tension. This roping method ensures equal tightness of all the hoisting ropes.

Advantages

The roping method according to the invention benefits in less labour, time, accidents, unnecessary work, rope jamming and rope damages because it keeps the bunch of ropes equally tight all the time. The hoisting ropes are unwound directly from the reels into the roping system and no hanging loops or rope ends are established because the hoisting ropes are unwound from the reels corresponding to the controlled rope lowering process. This prevents jamming behind snag points and thus any coating damages or other damages. This also helps to get the ropes equally tight. So, this means significant working time reduction and improved quality.

An advantage of the method according to the invention is that the installation of the ropes is much faster than with the methods known in the art. One additional benefit is that the installation is not physically demanding. A further advantage is that the method is simple and inexpensive.

LIST OF FIGURES

Figure 2:
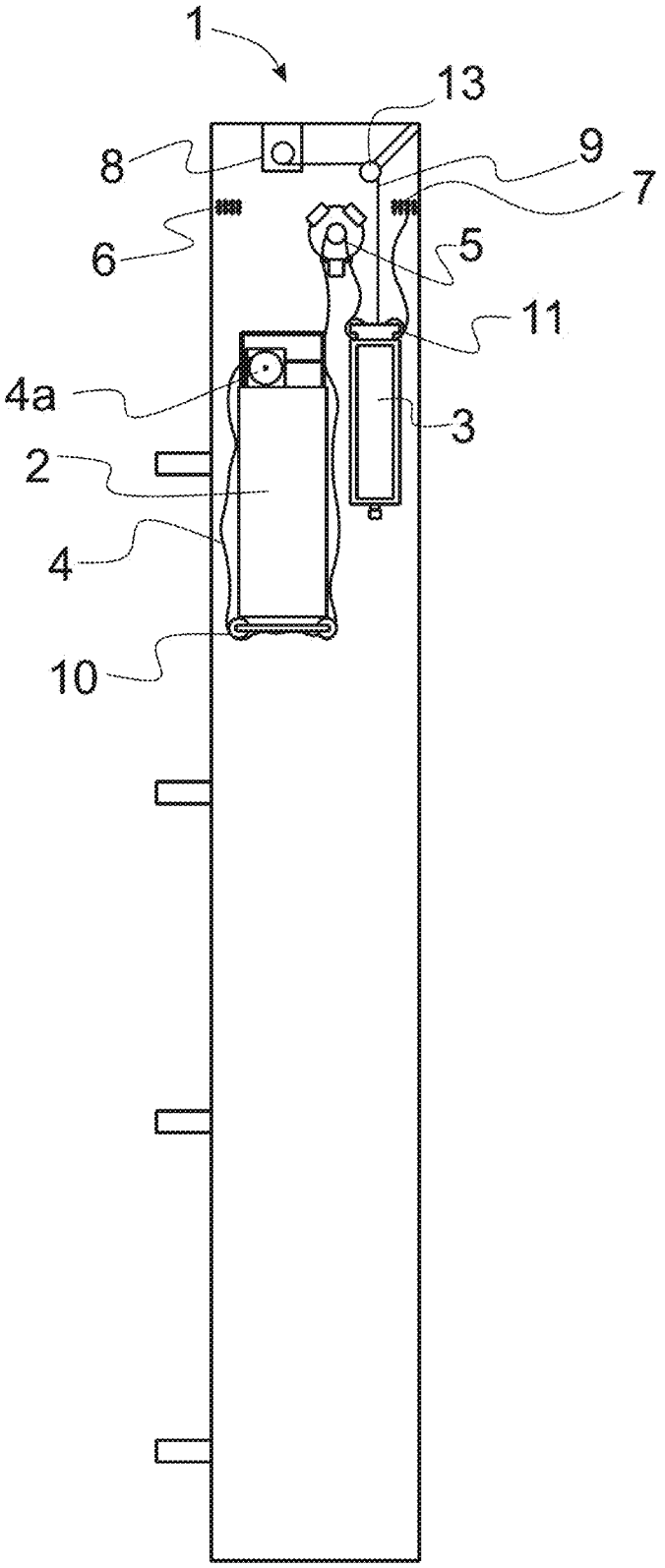
Figure 3:
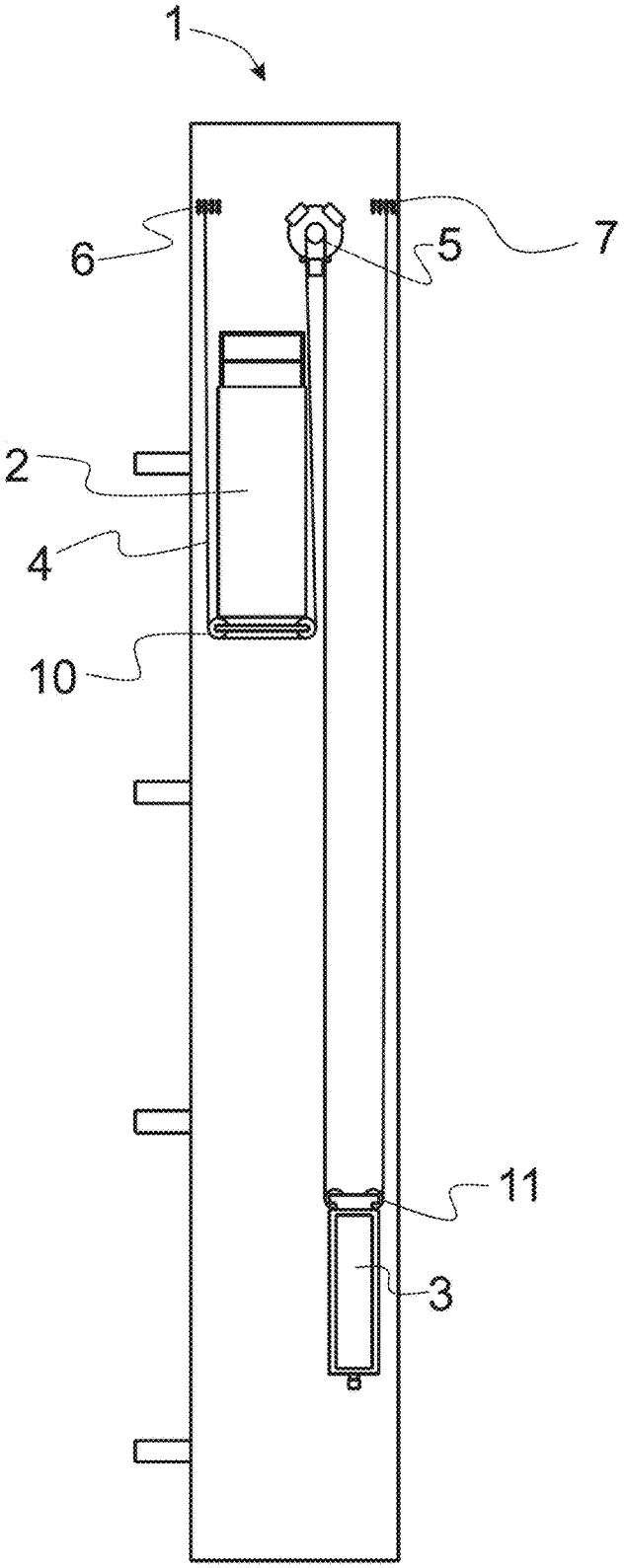

The invention will now be described in more detail with reference to the accompanying drawings, in which:

FIG. 1 presents in a simplified and diagrammatic side view an elevator shaft and the first phase of the roping method according to the invention, FIG. 2 presents in a simplified and diagrammatic side view an elevator shaft and the next phase of the roping method according to the invention and FIG. 3 presents in a simplified and diagrammatic side view an elevator shaft when the roping of the elevator has been completed.

DETAILED DESCRIPTION OF THE INVENTION

FIG. 1 presents in a simplified and diagrammatic side view an elevator shaft 1 where one wall is removed; an elevator car 2 in the shaft 1 which elevator car 2 comprises elevator car pulleys 10 acting as diverting pulleys; an auxiliary hoist 8 such as a man-riding hoist equipped with an auxiliary hoisting rope 9; a hoisting rope 4; a reel 4*a* for the hoisting rope 4; a counterweight 3 comprising counterweight pulleys 11 which act as diverting pulleys; a machinery traction sheave 5; a car side rope terminal 6 and a counterweight side rope terminal 7; an installation means 12, such as a rope, a chain or some other tool/tools, and an auxiliary diverting pulley 13. Preferably, the elevator comprises several parallel hoisting ropes 4. In this context the expression hoisting rope 4 means the whole set of parallel hoisting ropes.

Preferably, the elevator car pulleys 10 are placed at the bottom part of the elevator car 2 and the counterweight pulleys 11 are placed at the top part of the counterweight 3.

At the bottom part of the elevator shaft 1, the first end of the hoisting rope 4 is lowered from the reels 4*a* at the top of the car 2 on the side of the car side rope terminal 6 to the pit of the shaft 1. The installation means 12 is lowered from the other side of the car from the elevator 2 roof to the pit. Then the hoisting rope 4 is routed through the car pulleys 10. With the help of the installation means 12 the hoisting rope 4 is then pulled up to the elevator car 2 roof and fastened there to some fastening member, which is a part of the car 2 or attached to the car 2, for example the roof balustrade.

For the sake of clarity, only one hoisting rope 4 is mentioned here. However, the elevator can comprise also more than one hoisting ropes 4 and when one hoisting rope is mentioned all the hoisting ropes are meant. Similarly, when only one reel 4*a* is mentioned it means that there can be more than one parallel reels 4*a*, one for each hoisting rope 4.

FIG. 2 presents in a simplified and diagrammatic side view the elevator shaft 1 according to FIG. 1 in the next phase of the method.

In this phase of the method the elevator car 2 is hoisted to the upper part of the elevator shaft 1 with the help of the auxiliary hoist 8 and its rope 9, which auxiliary hoist 8 is placed above the elevator car 2. After hoisting the elevator car 2 it is parked and secured at the upper part of the elevator shaft 1 with safety members, parking chains and/or corresponding securing means, which are not shown in the figure. Also, the counterweight 3 has been hoisted up to the upper part of the elevator shaft 1 with the help of preferably the same auxiliary hoist 8 and its rope 9. When hoisting the counterweight 3 with the auxiliary hoist 8 the rope 9 is routed over the auxiliary diverting pulley 13, which is suitably fitted above the counterweight 3.

At the upper part of the elevator shaft 1 the first end of the hoisting rope 4 is uncoupled from the fastening member, to which it was fastened at the bottom part of the elevator shaft 1. Then the hoisting rope 4 is routed over the machinery traction sheave 5 and under the counterweight pulleys 11. Then the first end of the hoisting rope 4 is fixed to the counterweight side rope terminal 7 at the counterweight side of the shaft.

FIG. 3 presents in a simplified and diagrammatic side view the elevator shaft 1 according to FIG. 1 in the next phase of the method.

In the next phase or the final phase of the method the counterweight 3 is lowered towards the pit until it reaches the pre-set stopper means in the bottom part of the elevator shaft 1. The stopper means is not shown in the figures. During the lowering of the counterweight 3, the hoisting ropes 4 are unwound from the reels 4*a* through the whole roping system and the mass of the counterweight 3 stretches the hoisting ropes 4 to their full length. The stopper means is placed in the pit at such a height that after the lowering when the counterweight 3 is stopped by the stopper means the hoisting ropes 4 have at the same time been elongated to their normal length of use. Thus, when the counterweight 3 reaches the stopper means the rope length is at the same time essentially correct. The second ends of the hoisting ropes 4 are fixed to the car side rope terminal 6 and tightened to the correct and wanted tension. The counterweight 3 is lowered with the help of the auxiliary hoist 8.

It is obvious to the person skilled in the art that the invention is not restricted to the examples described above but that it may be varied within the scope of the claims presented below. Thus, for instance the method can comprise also different phases than those described above.

It is also obvious to the person skilled in the art that the method according to the invention can be used also in different kind of elevators than the elevator described above.

It is also obvious to the person skilled in the art that the diverting pulleys in the elevator car can be at the top part of the elevator car and the diverting pulleys in the counterweight can be at the lower part of the counterweight.

It is also obvious to the person skilled in the art that there can be more than one installation means or some other method can be used to lift the hoisting ropes to the car roof than using an installation means, such as a rope or ropes.

It is also obvious to the person skilled in the art that the counterweight is not necessarily in its final weight in the installation phase. For example, just part of the weight is installed in the installation phase and the rest is added later.

It is also obvious to the person skilled in the art that the auxiliary hoist can also be placed on top of the counterweight instead of on top of the elevator car. In this case, the auxiliary diverting pulley is placed on top of the elevator car. In this way the auxiliary diverting pulley is used to align the auxiliary hoisting rope to a correct line with the object to be hoisted.

The invention claimed is:

1. A method of roping an elevator, the elevator including an elevator car, equipped with car pulleys and arranged to run up and down in an elevator shaft, a counterweight, equipped with counterweight pulleys and connected to the elevator car with at least a hoisting rope from above, a machinery traction sheave at an upper part of the elevator shaft, a car side rope terminal and a counterweight side rope terminal, the method comprising:

routing a first end of each hoisting rope from a first side of the elevator car under the car pulleys and up a second side of the elevator car while the elevator car is at a lower part of the elevator shaft and fastening the first end of each of the hoisting ropes to a temporary fastening point at an upper part of the elevator car;

hoisting the elevator car and the counterweight to a top part of the elevator shaft and routing the first end of each hoisting rope around the machinery traction sheave and the counterweight pulleys and thereafter fastening the first end of each hoisting rope to the counterweight side rope terminal;

lowering the counterweight to the lower part of the elevator shaft so that the counterweight pulls each hoisting rope from a reel on a car roof of the elevator car through the car pulleys, the machinery traction sheave and the counterweight pulleys as the counterweight is lowered; and fastening a second end of each hoisting rope to the car side rope terminal.

2. The method according to claim 1, wherein the routing comprises:

routing each hoisting rope from the first side of the elevator car under the car pulleys under the elevator car and raised from the second side of the elevator car to the temporary fastening point at the upper part of the elevator car where the first end of each hoisting rope is temporarily fastened.

3. The method according to claim 1, wherein the routing comprises:

lifting the first end of each hoisting rope up to the car roof via an installation rope.

4. The method according to claim 1, wherein the hoisting comprises:

hoisting the elevator car and the counterweight to the upper part of the elevator shaft with an auxiliary hoist equipped with an auxiliary hoisting rope.

5. The method according to claim 4, wherein the hoisting comprises:

hoisting the elevator car and the counterweight to the upper part of the elevator shaft with the same auxiliary hoist and with the same auxiliary hoisting rope, using an auxiliary diverting pulley to align the auxiliary hoisting rope.

6. The method according to claim 4, the lowering comprises:

lowering the counterweight via the auxiliary hoist.

7. The method according to claim 1, further comprising:

securing, after the hoisting, the elevator car and the counterweight to the upper part of the elevator shaft.

8. The method according to claim 1, the lowering comprises:

lowering the counterweight until the counterweight reaches a pre-set stopper in a pit of the elevator shaft such that, while lowering the counterweight, each hoisting rope is unwound from each reel and stretched about the car pulleys, the machinery traction sheave and the counterweight pulleys to their length of use.

9. The method according to claim 8, wherein the stopper is in the pit at such a height that, when the counterweight is stopped by the stopper, the hoisting ropes have been elongated to their length of use.

10. The method according to claim 1, wherein the lowering comprises:

lowering the counterweight such that each hoisting rope is tightened by the lowering of the counterweight.

11. The method according to claim 1, wherein a tension of each of the hoisting ropes is equalized in response to the lowering of the counterweight.

12. The method according to claim 1, further comprising:

placing the reels for the hoisting ropes on top of the car roof of the elevator car.

13. The method according to claim 1, wherein the lowering comprises:

stretching each hoisting rope as the counterweight is lowered to the lower part of the elevator shaft while the first end of each hoisting rope is fastened to the counterweight side rope terminal.

14. The method according to claim 13, wherein, as the counterweight is lowered, each hoisting rope is unwound from respective reels connected to the second end of respective ones of hoisting ropes.

15. A method of roping an elevator, the elevator including an elevator car, equipped with car pulleys and arranged to run up and down in an elevator shaft, a counterweight, equipped with counterweight pulleys and connected to the elevator car with hoisting ropes from above, a machinery traction sheave at an upper part of the elevator shaft, the method comprising:

hoisting the elevator car and the counterweight to a top part of an elevator shaft and routing a first end of each hoisting rope around the machinery traction sheave and the counterweight pulleys and thereafter fastening the first end of each hoisting rope to a counterweight side rope terminal; and lowering the counterweight to a lower part of the elevator shaft so that the counterweight pulls the hoisting ropes from reels on a car roof of the elevator car through the car pulleys, the machinery traction sheave and the counterweight pulleys as the counterweight is lowered.

16. The method according to claim 15, wherein the lowering comprises:

stretching the hoisting ropes as the counterweight is lowered to the lower part of the elevator shaft while the first end of each hoisting rope is fastened to the counterweight side rope terminal.

17. The method according to claim 16, wherein, as the counterweight is lowered, the hoisting ropes are unwound from respective ones of the reels connected to the second end of respective ones of hoisting ropes.

* * * * *